US005620310A

United States Patent [19]

Takenaka et al.

[11] Patent Number: 5,620,310

[45] Date of Patent: Apr. 15, 1997

[54] CONTROL VALVE FOR A VARIABLE DISPLACEMENT REFRIGERANT COMPRESSOR

[75] Inventors: Kenji Takenaka; Toru Takeichi, both of Kariya, Japan

[73] Assignee: Kabushiki Kaisha Toyoda Jidoshokki Seisakusho, Aichi, Japan

[21] Appl. No.: 302,662

[22] PCT Filed: Jan. 11, 1994

[86] PCT No.: PCT/JP94/00026

§ 371 Date: Aug. 31, 1994

§ 102(e) Date: Aug. 31, 1994

[87] PCT Pub. No.: WO94/16225

PCT Pub. Date: Jul. 21, 1994

[30] Foreign Application Priority Data

Jan. 11, 1993 [JP] Japan ..... 5-002655

[51] Int. Cl.[6] ..... F04B 1/26

[52] U.S. Cl. ..... 417/222.2; 417/270

[58] Field of Search ..... 417/222.2, 222.1, 417/270, 309

[56] References Cited

U.S. PATENT DOCUMENTS

| | | | |
|---|---|---|---|
| 4,428,718 | 1/1984 | Skinner . | |
| 4,480,964 | 11/1984 | Skinner | 417/222.2 |
| 4,747,753 | 5/1988 | Taguchi | 417/270 |
| 4,780,059 | 10/1988 | Taguchi | 417/270 |
| 5,332,365 | 7/1994 | Taguchi | 417/270 |

FOREIGN PATENT DOCUMENTS

| | | | |
|---|---|---|---|
| 1138270 | 2/1955 | France | 417/270 |
| 293866 | 9/1991 | Germany | 417/270 |
| 158382 | 9/1983 | Japan . | |
| 89/06752 | 7/1989 | Japan | 417/222.2 |
| 123281 | 3/1994 | Japan . | |

*Primary Examiner*—Richard A. Berisch
*Assistant Examiner*—Ted Kim
*Attorney, Agent, or Firm*—Burgess, Ryan and Wayne

[57] ABSTRACT

A control valve for a variable displacement refrigerating compressor for an automobile climate control system for controlling fluid communication between the crank chamber and the discharge chamber of the compressor. The valve has axially arranged pressure-sensing unit having a diaphragm (13), a valve unit (17,23*c*) arranged so as to control a fluid communication of the passageway (23*a*) between the crank and discharge chambers of the compressor, a compensating unit having a balancing rod (18) compensating for the fluid-communication controlling operation of the valve unit (17,23*c*) in relation to the crank-pressure (Pc) and the discharge pressure (Pd), and a compensation-stopping unit (19,25) stopping the compensation operation of the compensating unit. The control valve permits the compressor to exhibit a satisfactory refrigerating performance irrespective of the ambient temperature.

6 Claims, 5 Drawing Sheets

CONTROL VALVE FOR A VARIABLE DISPLACEMENT REFRIGERANT COMPRESSOR

TECHNICAL FIELD

The present invention relates generally to a flow control valve adapted for being incorporated in a variable displacement refrigerant compressor. More particularly, it relates to a control valve for controlling a pressure level in a crank chamber of a variable displacement refrigerant compressor provided with a suction chamber for refrigerant gas before compression, a discharge chamber for the refrigerant gas after compression, and a crank chamber for receiving therein a compression mechanism driven by a drive shaft, in order to adjustably change an amount of compressed refrigerant gas delivered from the compressor toward a car climate control system.

PRIOR ART

U.S. Pat. No. 4,428,718 discloses a variable displacement refrigerant compressor including an open ended cylinder block having a plurality of cylinder bores arranged around an axis of the compressor, a front housing connected to the front end of the cylinder block so as to define a crank chamber therein extending in front of the front end of the cylinder block, a rear housing connected to the rear end of the cylinder block so as to define therein a suction chamber for receiving refrigerant gas before compression and a discharge chamber for receiving the refrigerant gas after compression. The crank chamber receives therein an axial drive shaft having one end rotatably supported by the cylinder block and the other end also rotatably supported by the front housing. The drive shaft has a swash plate supported thereon so as to be capable of rotating together with the drive shaft and of changing an angle of inclination with respect to a plane perpendicular to the axis of the drive shaft. The swash plate has a non-rotatable wobble plate mounted thereon via a thrust bearing. The wobble plate capable of changing an angle of inclination thereof together with the swash plate is connected to plurality of pistons via connecting rods so that respective pistons are able to reciprocate in corresponding respective cylinder bores.

A valve plate, suction valves, and discharge valves are arranged between the rear end of the cylinder block and the rear housing. Namely, the respective cylinder bores of the cylinder block are alternately communicated with the suction and discharge chambers of the rear housing via the suction and discharge valves during the reciprocation of the pistons.

The rear housing receives therein a control valve provided with pressure-sensitive bellows capable of displacing in response to detection of a gas pressure under suction at the inlet port of the compressor, and a valve mechanism operating in response to the displacement of the bellows so as to change an opening degree of a fluid communication passageway between the crank chamber and the discharge chamber and an opening degree of a fluid communication passageway between the crank chamber and the suction chamber.

In the above-mentioned compressor of U.S. Pat. No. 4,428,718, when the gas pressure under suction detected at the inlet port of the compressor increases above a predetermined level in relation to a rise of an ambient temperature, the bellows of the control valve is compressed so as to move the valve mechanism so that the opening degree of the communication passageway between the crank chamber and the suction chamber is increased while closing the communication passageway between the crank chamber and the discharge chamber. Thus, the pressure level in the crank chamber is reduced due to extraction of a pressurized gas from the crank chamber toward the suction chamber. Accordingly, back pressure acting on the respective pistons is lowered so as to increase the angle of inclination of the swash and wabble plates. Consequently, the reciprocating stroke of the respective pistons is increased so as to increase the displacement of the compressor.

On the contrary, when the gas pressure under suction detected at the inlet port of the compressor is reduced to the predetermined level in relation to a fall of the ambient temperature, the communication passageway between the crank chamber and the suction chamber is closed by the control valve which simultaneously functions to widely open the fluid communication between the crank chamber and the discharge chamber. Thus, the crank chamber is supplied with the pressurized gas so as to increase the pressure level therein. Accordingly, the back pressure acting on the pistons increases so as to reduce the angle of inclination of the swash and wobble plates. Consequently, the reciprocating stroke of the respective pistons is decreased so as to reduce the displacement of the compressor.

In the described variable displacement compressor, the control valve must however suffer from such an unfavorable condition that the bellows of the control valve are displaced by a force which is apt to change depending on a widely changing discharge pressure of the compressor. Thus, the opening degree of the fluid communication between the crank chamber and the suction and discharge chambers must be determined by the affect of the discharge pressure of the compressor. To this end, when the ambient temperature is relatively high, the valve mechanism of the control valve of the compressor might be able to maintain the opening degree of the communication between the crank chamber and the suction and discharge chambers at positions enabling the compressor to exhibit a large refrigerating function even under the condition that the discharge pressure is large. Nevertheless, when the ambient temperature is relatively low, the discharge pressure of the compressor is greatly reduced, and therefore, the valve mechanism of the control valve moves to a position whereat the fluid communication between the crank and suction chambers is unnecessarily increased to thereby excessively reduce the displacement of the compressor while increasing the gas pressure at the inlet port of the compressor. Accordingly, the refrigerating function of the compressor must be lowered.

Further, when the variable refrigerant compressor incorporating therein the above-mentioned pressure-sensitive bellows type control valve is incorporated in a certain type of car, such as civic-use cars in Japan, an additional defect described below occurs. Namely, the climate control system incorporated in the civic-use cars is provided with a switching system enabling an alternative use of either an external air or an internal air of the car for carrying out the climate control to thereby prevent an entrance of bad smell of the external air into the car compartment during a traffic jam. Therefore, when the internal air is used and circulated through the climate control system and the car compartment to control the temperature in the car compartment, a lack of refrigeration occurs because the ambient temperature of the external air is usually low, and accordingly, the window panes of the car are frosted due to a temperature differential between the temperature of the internal air and that of the external air.

In order to solve the above-mentioned problem, when the ambient temperature is relatively low, it may be possible to either increase a pressure sensitive area of the bellows of the control valve or reduce the fluid communication between the crank chamber and the suction and discharge chambers so that a rise of the gas pressure detected at the inlet port of the compressor is prevented to thereby obtain a small absolute inclination of the line indicating the relationship between the ambient temperature and the suction pressure.

Nevertheless, when the pressure-sensitive area of the bellows of the control valve are increased, the size of the bellows and in turn, of the control valve must be large, and accordingly, the mounting of the control valve in the variable displacement compressor becomes cumbersome. Also, the controlling performance, i.e., the response characteristics of the control valve is deteriorated.

When the fluid communication between the crank chamber and the suction and discharge chambers is reduced, the amount of flow of the pressurized gas flowing from the discharge chamber toward the crank chamber is reduced, and accordingly, the controlling performance of the control valve is lowered.

Thus, the pending Japanese Patent Application No. 4-270368 has proposed a novel type control valve improved over the above-mentioned pressure-sensitive type control valve of U.S. Pat. No. '718, for a variable displacement compressor. The proposed control valve is constructed so that it may exhibit a sufficient refrigeration function irrespective of the ambient temperature without sacrificing ease of mounting in the compressor body and of an appropriate controlling performance.

The control valve of JP-A-No. '368 includes a pressure-sensing mechanism capable of moving in response to a detection of suction pressure, a valve mechanism capable of controlling the opening degree of a fluid communication at least between the discharge chamber and the crank chamber in response to the movement of the pressure-sensing mechanism, a compensating mechanism capable of compensating for the fluid-communication-controlling operation of the valve mechanism by adjusting an affect of the discharge pressure through opposing the pressure in the crank chamber against the discharge pressure, and a compensation stopping mechanism capable of stopping the compensating operation of the compensating mechanism when the discharge pressure is above a predetermined pressure level.

However, as shown in FIG. 5, the construction of the proposed control valve 30 is rather complicated, and accordingly, the manufacturing cost of the control valve is raised.

The control valve 30 includes a valve mechanism provided with a discharge pressure chamber 52 communicating with a crank chamber of a variable displacement refrigerant compressor via a valve seat, and a spherical valve element 45 connected to an end of a rod 43 that is connected, at the other end, to a diaphragm 33 functioning as a pressure-sensing element sensitive to a suction pressure Ps of the compressor. The spherical valve element 45 is axially moved toward and away from the valve seat together with the rod 43, and when the suction pressure Ps increases, the spherical valve element 45 is seated against the valve seat.

The compensating mechanism of the control valve 30 is provided between the diaphragm 33 and the discharge chamber 52, and includes a compensation chamber 53 communicating with the discharge pressure chamber 52 via the compensation stopping mechanism, and also communicating with the crank chamber of the compressor via an annular gap surrounding the rod 43, and a control piston 44 fixedly connected to the rod 43 and sliding in the compensation chamber 53.

The compensation stopping mechanism is provided with a compensation stopping chamber 48*a* arranged between axial one portion (the upper portion) of the compensation chamber 53 and the discharge pressure chamber 52, and a valve element 49 movably arranged in the compensation stopping chamber 48*a* and biased toward the discharge pressure chamber 52 by a biasing force of a spring 48.

In accordance with the above-described control valve 30, the compensation chamber 53 is arranged at an intermediate position between the discharge pressure chamber 52 receiving therein the spherical valve element 45 and the diaphragm 33, and the compensation stopping chamber 48*a* receiving therein the spring 48 and the valve element 49 is arranged so as to be parallel with the rod 43. Therefore, the internal construction of the control valve 30 is very complicated, and accordingly, the cost for manufacturing and assembling the valve 30 is raised.

DISCLOSURE OF THE INVENTION

Therefore, an object of the present invention is to provide a control valve which is suitable for being incorporated in a variable displacement refrigerant compressor for a climate control system of a car, and provided with a simple internal construction thereof.

Another object of the present invention is to provide a control valve which is suitable for being incorporated in a variable displacement refrigerant compressor for a climate control system of a car, and which permits the compressor to exhibit a sufficient refrigerating performance irrespective of the ambient temperature of the car without lowering the feasibility of simply incorporating it in the compressor as well as not deteriorating the controlling performance thereof.

In accordance with the present invention, there is provided a control valve adapted for being incorporated in a variable displacement refrigerant compressor of a car-climate control system, the compressor being provided with a suction chamber for refrigerant before compression, a discharge chamber for the refrigerant after compression, and a crank chamber for receiving therein a compression-drive mechanism, the control valve being provided with a pressure-sensing means for providing a movement thereof in response to detection of a change in suction pressure of the refrigerant gas, and a valve means for controlling an opening degree of a fluid communication passageway extending between at least the discharge chamber and the crank chamber in relation to the movement of the pressure-sensing means so as to adjustably changing pressure level in the crank chamber to thereby vary the displacement of the compressor, wherein the control valve is characterized by further comprising: a compensating means compensating for the opening-degree-controlling operation of the valve means by adjusting an application of the pressure of discharged refrigerant gas to the valve means; and a compensation-stopping means stopping the compensating operation of the compensating means when the pressure of the discharged refrigerant gas is lowered to a level below a predetermined pressure level, wherein the valve means comprises: a discharge pressure chamber directly communicating with the discharge chamber of the compressor and communicating with the crank chambers of the compressor via a valve seat; and a valve element provided so as to be moved in a first axial direction toward a position where it is seated against the valve seat when the pressure-sensing means provides the movement thereof in relation to a rise in the suction pressure, wherein the compensating means comprises: a compensating chamber arranged at a position spaced from the discharge pressure chamber in a second axial direction reverse to the first axial direction, the compensating chamber communicating with the crank chamber of the compressor; and a balancing rod slidably arranged between the discharge pressure chamber and the compensating chamber, the balancing rod being provided with one end integral with the valve element of the valve means and the other free end located in the compensating chamber; and, wherein the compensation-stopping means comprises: a compensation-stopping chamber arranged at a position further axially spaced from the discharge pressure chamber in the direction reverse to that of the axial movement of the valve means toward the valve seat, the compensation-stopping chamber communicating with the discharge chamber of the compressor; and a high-pressure-compensating rod slidably arranged between the compensating chamber and the compensation-stopping chamber, the high-pressure-compensating rod being separated from and brought into contact with the free end of the balancing rod of the compensating means, and being urged by a spring element in a direction separating from the free end of the balancing rod.

In the variable displacement refrigerant compressor incorporating therein the above-mentioned control valve, when the suction pressure of the refrigerant gas comes above a predetermined level in relation to a rise of the ambient temperature, the pressure-sensing unit of the control valve moves in the first axial direction by overcoming a predetermined set force, so that the valve element of the valve unit is seated against the valve seat of the discharge pressure chamber. Thus, the fluid communication between the discharge chamber and the crank chamber of the compressor is closed, and accordingly, the pressure level in the crank chamber of the compressor is lowered so as to increase the displacement of the compressor.

To the contrary, when the suction pressure of the refrigerant gas falls below the predetermined level in relation to a drop in the ambient temperature, the pressure-sensing unit of the control valve moves in the second axial direction under an affect by the predetermined set force, so that the valve element of the valve unit is separated away from the valve seat of the discharge pressure chamber. Thus, the fluid communication between the discharge chamber and the crank chamber of the compressor is provided, and accordingly, the pressure level in the crank chamber of the compressor is raised so as to reduce the displacement of the compressor.

During the operation of the compressor, when the discharge pressure of the compressor is below a predetermined pressure level, the high-pressure-compensating rod of the compensation-stopping unit is prevented by the biasing spring from moving in the first axial direction. Therefore, the balancing rod of the compensating unit receives the opposite discharge pressure and crank chamber pressure, and compensates the controlling operation of the valve element in response to a differential between the opposite pressures. Accordingly, the opening degree of the fluid communication passageway between the discharge chamber and the crank chamber of the compressor is determined by a combination of a first force exhibited by the valve unit so as to reduce the opening degree and a second force exhibited by the compensating unit so as to increase the opening degree. Thus, when the ambient temperature is relatively low, the valve unit of the control valve can operate so as to show a substantially linear relationship between the ambient temperature and the suction pressure which has a predetermined inclination suitable for permitting the compressor to exhibit a sufficient refrigerating performance.

Under the above-mentioned substantial linear relationship between the ambient temperature and the suction pressure, when the ambient temperature is relatively low, and when the discharge pressure of the compressor is greatly reduced, the control valve can maintain an appropriate controlling operation thereof. Namely the control valve prevents such reduction in the discharge pressure from becoming a cause for an unnecessary increase in the fluid communication between the crank chamber and the discharge chamber of the compressor. Therefore, the displacement of the compressor is not excessively reduced, and accordingly, a rise in the suction pressure is prevented so as to obtain a sufficient refrigerating performance of the variable displacement refrigerant compressor.

Also, in accordance with incorporation of the above-mentioned control valve into the variable displacement refrigerant compressor, the characteristic line of the compressor indicating the relationship between the ambient temperature and the suction pressure at the inlet port of the compressor neither comes in contact with nor passes through a region in which the window panes of the car are frosted. Thus, even if the temperature of the external air is considerably low, the climate control system can exhibit an appropriate refrigerating function so that the window panes of a car are not frosted.

On the other hand, during the operation of the variable displacement refrigerant compressor, when the discharge pressure is above the predetermined pressure level, the high-pressure compensating rod of the compensation-stopping unit of the control valve overcomes the biasing force of the spring by receiving the discharge pressure, and moves in the first axial direction in the compensation-stopping chamber. Thus, the moving high-pressure compensating rod presses the balancing rod so as to move it in the same first axial direction in the compensating chamber. Accordingly, the valve element of the valve unit is moved by a pressing force of the balancing rod in addition to a moving force provided by the pressure-sensing unit. Namely, the compensating unit is prevented by the compensation-stopping unit from conducting compensation of the controlling operation of the valve unit of the control valve. Accordingly, the control valve can operate so as to adjustably change the inclination of the linear characteristic line of the compressor indicating the relationship between the ambient temperature and the suction pressure of the compressor.

It will be understood from the foregoing that the control valve according to the present invention is able to provide the compressor with the above-mentioned advantageous operation without either increasing the pressure-sensitive area of the pressure-sensing unit thereof or reducing the cross-sectional area of the fluid communication passageway extending between the crank chamber and the discharge chamber of the compressor. Thus, neither the size of the control valve is increased nor the amount of flow of the refrigerant gas is reduced.

Further, in the control valve of the present invention, the compensating chamber of the compensating unit is arranged at a position axially spaced apart from the discharge pressure chamber in the second axial direction, and the compensation-stopping chamber can be arranged at a different position further axially spaced apart from the discharge pressure chamber in the second axial direction. Thus, the compensation-stopping unit is permitted to be arranged so as to maintain an axial registration with the pressure-sensing unit, the valve unit, and the compensating unit. Accordingly, it is apparent that the internal construction of the control valve can be simpler than that of the previously proposed control valve shown in FIG. 5.

BEST MODE OF CARRYING OUT THE INVENTION

Figure 1:
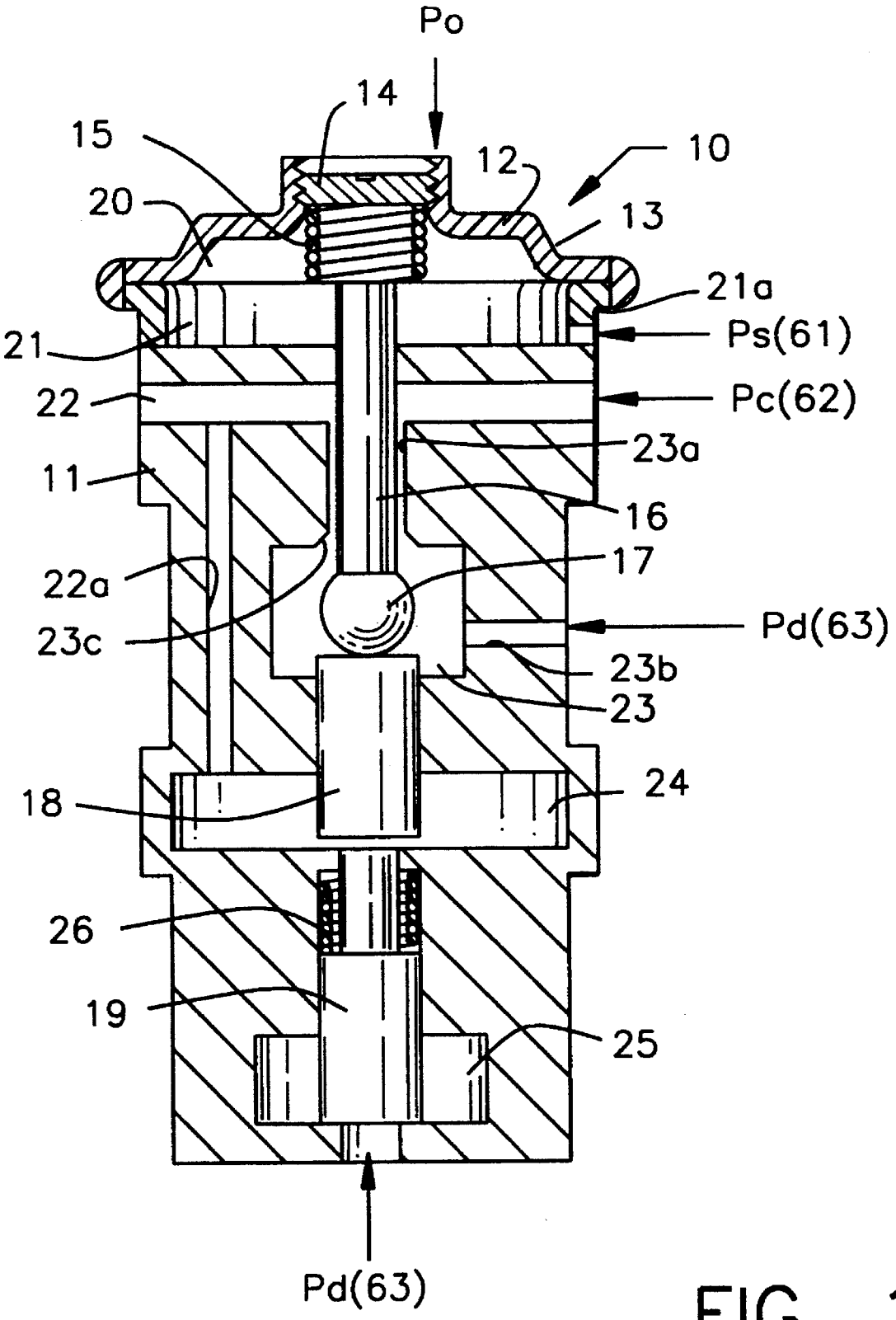
FIG. 1 is a cross-sectional view of a control valve adapted for being incorporated in a variable displacement refrigerant compressor, according to an embodiment of the present invention, illustrating a state wherein the compensation-stopping unit prevent the compensating unit from operating.
Figure 2:
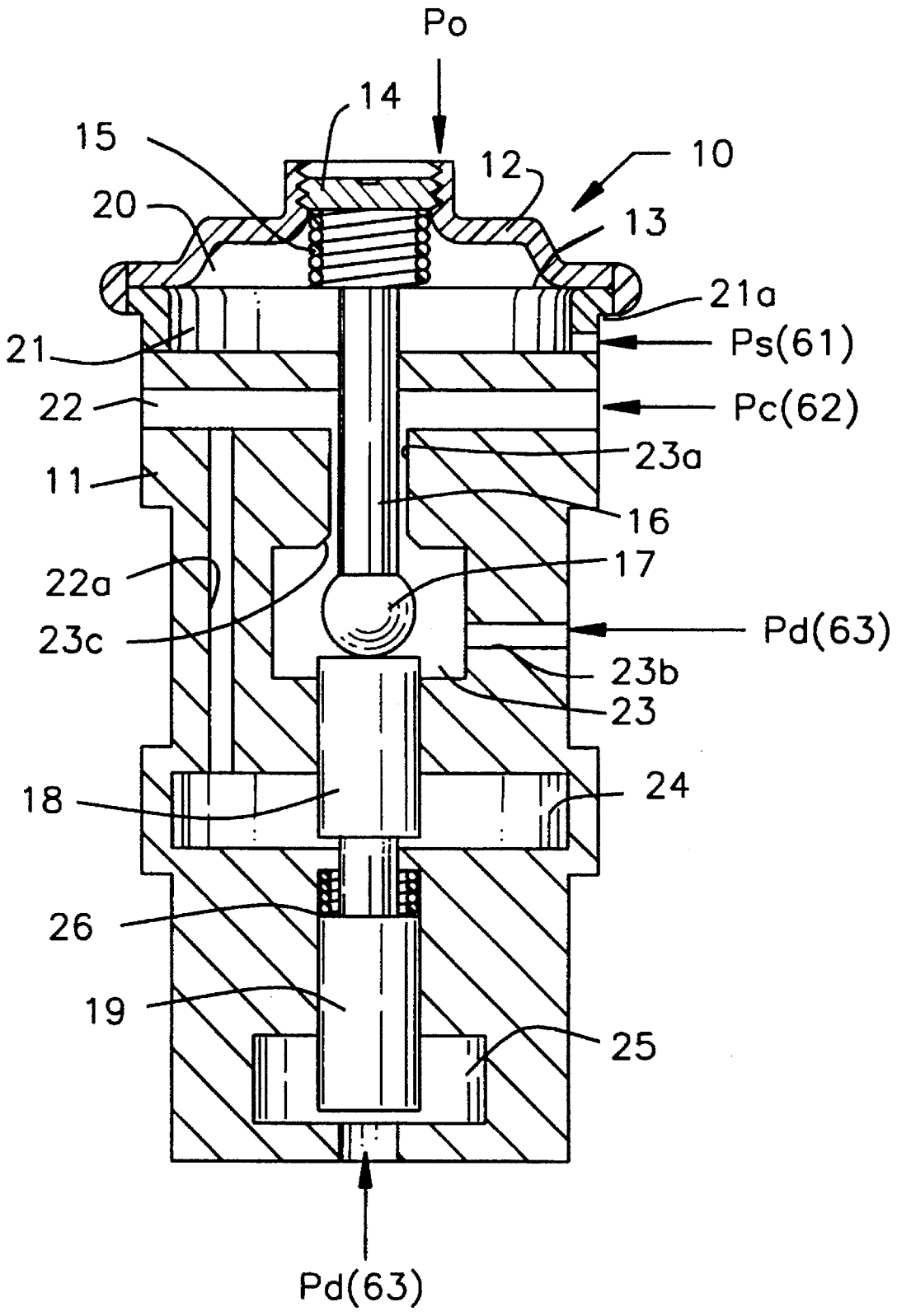
FIG. 2 is a similar cross-sectional view of a control valve according to the embodiment of the present invention, illustrating a state wherein the compensation-stopping unit permits the compensating unit to operate.

Referring to FIGS. 1 and 2, a control valve 10 suitable for being incorporated in a variable displacement refrigerant compressor, such as a wobble-plate-operated reciprocatory-piston type refrigerant compressor includes a valve body 11, a cap member 12 closing an end of the valve body 11, and a diaphragm 13 operating as a pressure-sensing element. The diaphragm 13 is arranged between and sandwiched by the upper end of the valve body 11 and the cap member 12, and has a predetermined pressure-sensing area. The cap member 12 has a central threaded bore in which a screw member 14 is threadedly engaged so as to close the bore. The cap member 12, the diaphragm 13, and the screw member 14 cooperate so as to define an atmospheric chamber 20 on one side of the diaphragm 13, and the chamber 20 is communicated with the atmosphere via a backlash provided in the threadedly engaged portion of the screw member 14 and the cap member 12 so that the atmospheric pressure $p_0$ prevails in the atmospheric chamber 20. A spring element 15 having a predetermined stiffness is arranged in the atmospheric chamber 20 in such a manner that one end of the spring element 15 is engaged with the screw member 14 and the other end thereof is engaged with the diaphragm 13.

The valve body 11 and the diaphragm 13 define a suction pressure chamber 21 arranged on the side of the diaphragm 13 and fluidly connected to a later-described communicating passageway 61 (FIG. 3) of the refrigerant compressor via a port-like communicating passageway 21*a* formed in the valve body 11. Thus, the suction pressure Ps of the compressor is introduced into the suction pressure chamber 21 of the control valve 10. A rod 16 is arranged so as to axially extend through the suction chamber 21, and one end (upper end) of the rod 16 is fixed to the diaphragm 13 on the side facing the suction pressure chamber 21. The other end of the rod 16 is provided with a ball, i.e., a spherical valve element 17 fixed thereto.

The valve body 11 is further provided with a crank-pressure chamber 22 formed therein so as to be axially spaced apart from the suction pressure chamber 22 communicating with a gas-supply passageway 62 (FIG. 3) of the compressor, and accordingly, the crank-pressure chamber 22 is supplied with gas pressure Pc of the crank chamber of the compressor.

The valve body 11 is furthermore provided with a discharge pressure chamber 23 formed therein so as to be axially spaced apart from the crank-pressure chamber 22. The discharge pressure chamber 23 communicates with the the crank-pressure chamber 22 via an annular-gap-like passageway 23*a* formed around the rod 16, and a valve seat 23*c* formed at one end of the passageway 23*a* so as to receive the spherical valve element 17. The discharge pressure chamber 23 communicates with a communicating passageway 63 (FIG. 3) of the compressor via a communicating passage 23*b* formed in the valve body 11 so that discharge pressure Pd of the compressor is introduced therein.

The valve body 11 is also provided with a compensating chamber 24 formed therein and arranged so as to be axially spaced apart from the discharge pressure chamber 23. The compensating chamber 24 in the form of a cylindrical chamber is fluidly isolated from the discharge pressure chamber 23 by a cylindrical balancing rod 18 axially slidably fit in the valve body 11 between the discharge pressure and compensating chambers 23 and 24. The compensating chamber 24 is, however, communicated with the crank-pressure chamber 22 via a communicating passageway 22*a* formed in the valve body 11. Thus, crank-pressure Pc prevails in the compensating chamber 24.

The balancing rod 18 is connected to the spherical valve element 17 at one end thereof so that the valve element 17 and the balancing rod 18 integrally move in the axial direction. The other end of the balancing rod 18 is formed as a free end.

It should be understood that the balancing rod 18 moving between the compensating chamber 24 and the discharge pressure chamber 23 by receiving opposite pressures Pd and Pc forms a compensating unit of the control valve 10.

The valve body 11 is further provided with a compensation stopping chamber 25 formed therein so as to be axially spaced apart from the compensating chamber 24. The compensation-stopping chamber 25 is fluidly isolated from the compensating chamber 24 by a high-pressure compensating rod 19 in the form of a cylindrical rod axially slidably fit in the valve body 11, and having a small diameter portion thereof capable of coming in contact with the free end of the balancing rod 18. A large diameter portion of the high-pressure compensating rod 19 axially extend through the compensation-stopping chamber 25, and the high-pressure compensating rod 19 is axially and constantly urged toward the compensation-stopping chamber 25 from the compensating chamber 24 by a biasing spring element 26 arranged around the small diameter portion of the rod 19.

The compensation-stopping chamber 25 communicates with the communicating passageway 63 (FIG. 3) of the compressor so that it is supplied with the discharge pressure Pd via the communicating passageway 63.

It should be understood that the high-pressure compensating rod 19, the compensation-stopping chamber 25, and the biasing spring element 26 form a compensation-stopping unit of the control valve 10.

From the foregoing description and the illustrations of FIGS. 1 and 2, it will be understood that the suction chamber 21, the crank-pressure chamber 22, the discharge pressure chamber 23, the compensating chamber 24, and the compensation-stopping chamber 25 are arranged so as to be mutually in axial registration with one another in the valve body 11.

Figure 3:
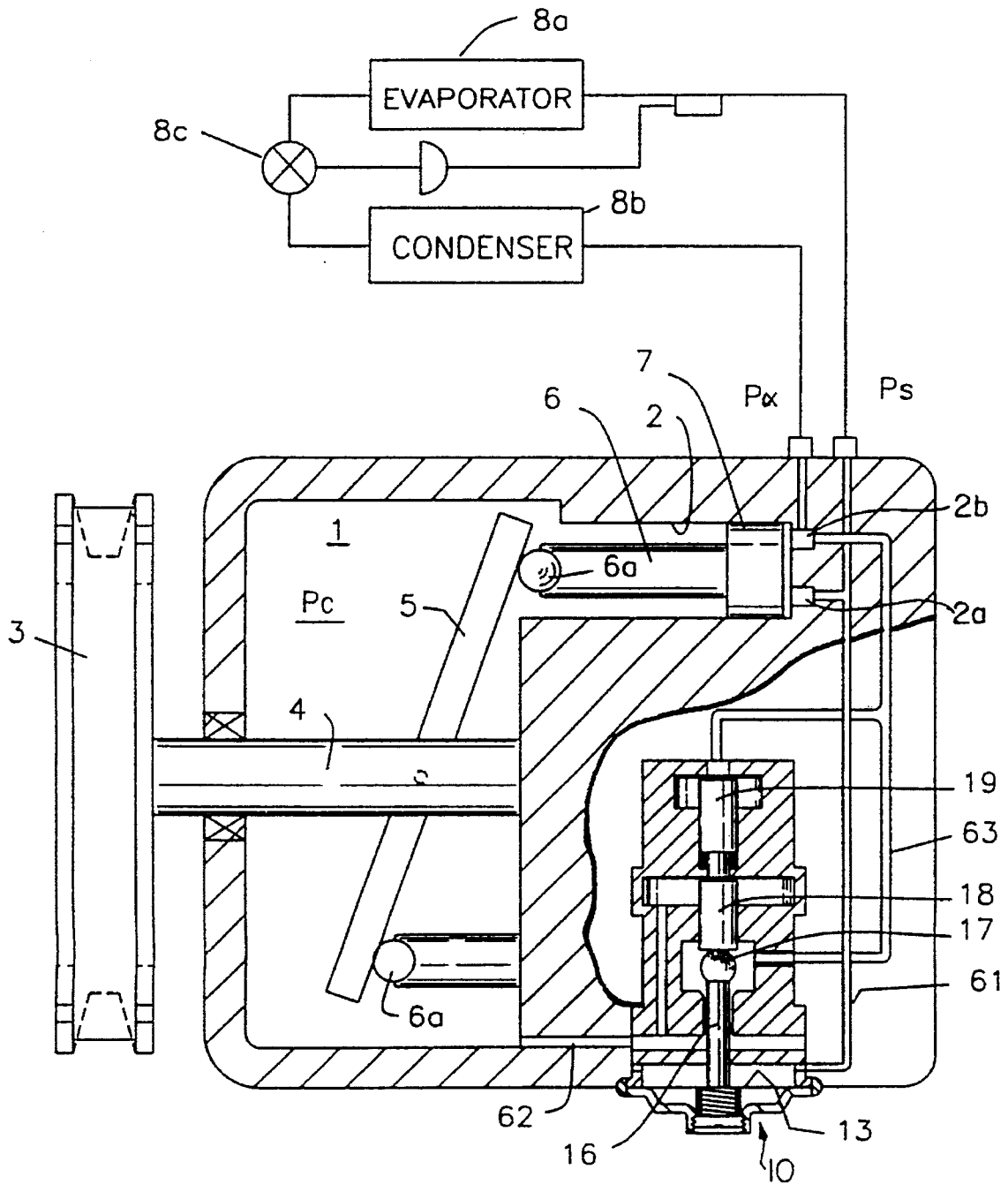
FIG. 3 is schematic cross-sectional view of a variable displacement wobble plate type refrigerant compressor in which the control valve of the present invention is incorporated.

The control valve 10 having the above-described construction is incorporated in a variable displacement wobble plate type refrigerant compressor having a plurality of reciprocating pistons 7 in such a manner as schematically shown in FIG. 3.

In FIG. 3, the compressor suitable for being used in a car climate control system is provided with an outer framework comprised of an intermediate cylinder block, a front housing, and a rear housing. The front housing and the intermediate cylinder block defines therein a crank chamber 1 for receiving a wobble plate mechanism to reciprocate the pistons 7 in respective cylinder bores 2 during rotation of a drive shaft 4.

Although not shown in FIG. 3, a swash plate is mounted on the drive shaft 4 connected to a solenoid type clutch 3, and supports thereon the wobble plate 5 so as to cause the nutating motion of the wobble plate 5 in response to the rotation of the drive shaft 4. The wobble plate 5 is operatively engaged with respective pistons 7 via ball-like shoes 6*a* and connecting rods 6.

The rear housing of the outer framework of the compressor is provided with a suction chamber (not shown in FIG. 3) for receiving the refrigerant gas before compression at suction pressure Ps, and a discharge chamber (not shown in FIG. 3) for receiving the refrigerant gas after compression at discharge pressure Pd. The suction chamber and the discharge chamber are respectively communicated with each of the plurality of cylinder bores 2 via a valve plate and respective suction and discharge valves (not shown in FIG. 3).

The suction chamber of the compressor is fluidly connected to an evaporator 8*a* in the refrigerating circuit, and the discharge chamber of the compressor is fluidly connected to a condenser 8*b* of the refrigerating circuit. The evaporator 8*a* and the condenser 8*b* are connected to one another via an expansion valve 8*c*.

The rear housing of the compressor also receives the afore-mentioned control valve 10 therein, and is provided with the communicating passageway 61 communicating between the suction chamber and the suction pressure chamber 21 of the control valve 10, the communicating passageway 63 communicating between the discharge chamber and the discharge pressure chamber 23 of the control valve 10, and the gas-supply passageway 62 extending between the crank chamber 1 and the crank-pressure chamber 22 of the control valve 10.

The compressor of FIG. 3 is further provided with a gas extraction passageway (not shown in FIG. 3) extending between the crank chamber 1 and the suction chamber through the cylinder block and the rear housing.

The operation of the variable displacement compressor provided with the control valve 10 will be described hereinafter.

When the drive shaft 4 is rotationally driven by a car engine via the solenoid type clutch 3, the non-rotating wobble plate 5 having a predetermined inclination angle with respect to a plane perpendicular to the axis of rotation of the drive shaft 4 carries out the nutating motion via the swash plate (not shown in FIG. 3). Thus, the pistons 7 reciprocate within the respective cylinder bores 2. Therefore, the refrigerant gas introduced from the evaporator 8*a* into the compressor is sucked into respective cylinder bores 2 in response to the suction stroke of the respective pistons 7. The refrigerant gas is then compressed within the respective cylinder bores 2, and discharged from the cylinder bores 2 toward the discharge chamber from where the compressed refrigerant gas is delivered toward the condenser 8*b*.

At this stage, when the ambient temperature around the car rises, and when the suction pressure Ps is above a predetermined pressure level, the diaphragm 13 of the control valve 10 is moved upward in FIG. 1 by overcoming the atmospheric pressure Po and the spring force of the spring element 15. Therefore, the spherical valve element 17 moving together with the valve rod 16 is seated against the valve seat 23*a*. Accordingly, the annular passageway 23*a* between the discharge pressure chamber 23 communicated with the discharge chamber of the compressor and the crank-pressure chamber 22 communicated with the crank chamber 1 of the compressor is closed by the spherical valve element 17.

Since the crank chamber 1 and the suction chamber of the compressor are constantly communicated with one another by the afore-mentioned gas-extraction passageway (not shown) having therein an orifice, the gas is constantly extracted from the crank chamber 1 toward the suction chamber via the gas-extraction passageway. The amount of extraction of the gas is determined by the orifice.

When the spherical valve element 17 is seated against the valve seat 23*c*, supply of the compressed high-pressure refrigerant gas from the discharge chamber into the crank chamber 1 of the compressor via the control valve 10 is interrupted, and accordingly, the crank-pressure Pc in the crank chamber 1 of the compressor is lowered so as to reduce a back pressure acting on the respective pistons 7. Therefore, the angle of inclination of the wobble plate 5 is increased so as to increase the reciprocating stroke of the pistons 7 to thereby increase the displacement of the compressor.

On the contrary, when the ambient temperature around the car falls, and when the suction pressure Ps of the refrigerant gas is lowered, the diaphragm 13 of the control valve 10 is moved downward in FIG. 1 by the force of the spring 15 and the atmospheric pressure $P_0$. Thus, the spherical valve element 17 is moved away from the valve seat 23*c* via the axial movement of the rod 16. Accordingly, the discharge chamber and the crank chamber 1 of the compressor are communicated with one another via the annular passageway 23*a* of the control valve 10. Thus, a rise of the crank-pressure Pc in the crank chamber 1 of the compressor occurs, and therefore, a back pressure acting on the respective pistons 7 goes up so as to reduce the angle of inclination of the wobble plate 5. Accordingly, the reciprocating stroke of the respective pistons 7 is reduced so as to decrease the displacement of the compressor.

During the operation of the compressor, when the discharge pressure Pd does not come above a predetermined pressure level $Pd_0$, the high-pressure compensating rod 19 is not moved up in FIG. 1 by receiving the force of the biasing spring 26 which is larger than the total pressing force of the discharge pressure Pd. Therefore, the balancing rod 18 located above the high-pressure compensating rod 19 in FIG. 1 compensates for the communication controlling operation of the spherical valve element 17 in response to a pressure differential between the discharge pressure Pd prevailing in the discharge pressure chamber 23 and the crank-pressure Pc prevailing in the compensating chamber 24. Namely, the opening degree of the annular passageway 23*a* fluidly communicating between the crank-pressure chamber 22 and the discharge pressure chamber 24 is determined by the movement of the spherical valve element 17 controlled by both the discharge pressure Pd and the force provided by the balancing rod 18 of the compensating unit.

Figure 4:
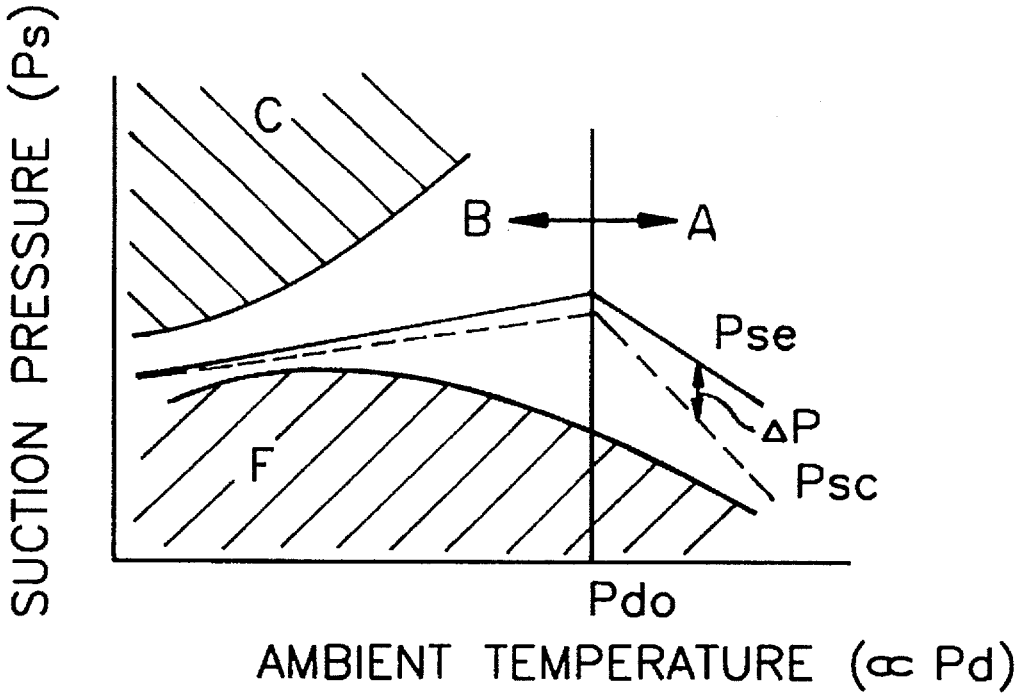
FIG. 4 is a graphical view of a characteristic line indicating a relationship between the ambient temperature and the suction pressure of the variable displacement wobble plate type refrigerant compressor in which the control valve according to the embodiment of the present invention is incorporated; and, FIG. 5 is a cross-sectional view of the previously proposed control valve.

At this stage, referring to the graph of FIG. 4 indicating the characteristic lines of the operation of the variable displacement refrigerant compressor shown in FIG. 3, when the ambient temperature is low (a region "B" in FIG. 4), the compressor can exhibit a sufficient refrigerating performance by the communication control operation of the spherical valve element 17 of the control valve 10. Namely, the control valve 10 can control the operation of the compressor so that the line indicating the relationship between the ambient temperature (the abscissa) and the suction pressure Ps (the ordinate) may have an inclination set so as to constantly maintain a sufficient refrigerating performance. The characteristic line Psc shown by a chain line indicates a gas pressure detected at the inlet port of the compressor, and the characteristic line Pse shown by an actual line indicates a gas pressure detected at the output of the evaporator 8*a*. A pressure differential between both pressures Psc and Pse is indicated by ΔP.

When the variable displacement refrigerant compressor provided with the control valve 10 has the characteristic relationship between the ambient temperature and the suction pressure Ps, as shown in FIG. 4, in the region of relatively low ambient temperature, the control valve 10 does not operate so as to inappropriately increase the fluid communication passageway formed therein, i.e., the annular passageway 23*a* between the crank chamber 1 and the discharge chamber of the compressor, even if a large reduction of the discharge pressure Pd occurs. Thus, the displacement of the compressor does not excessively reduce. Accordingly, a rise of the suction pressure Ps is prevented so as to obtain a large refrigerating performance of the compressor.

Further, in the control valve 10 having the characteristic relationship as shown in FIG. 4, the characteristic line neither comes in contact with nor passes through the region "F" in which frosting occurs nor a region "C" in which the car window pane is frosted.

On the other hand, when the discharge pressure Pd of the compressor comes above the predetermined pressure level $Pd_0$, the high-pressure compensating rod 19 moves upward in FIG. 2 under the discharge pressure Pd while overcoming the spring force of the biasing spring element 26. Thus, the high-pressure compensating rod 19 presses the balancing rod 18 so as to move it upward within the compensating chamber 24. Accordingly, the spherical valve element 17 moves upward by the force provided by the moving diaphragm 13 and the pressure of the balancing rod 18. Namely, when the pressure receiving area of the high-pressure compensating rod 19 which receives the discharge pressure Pd is appropriately set, the force applied by the balancing rod 18 to the spherical valve element 17 is easily adjusted. Thus, since the high-pressure compensating rod 19 presses the spherical valve element 17 via the balancing rod 18, the controlling of the spherical valve element 17 is not carried out by the balancing rod 18. Accordingly, when there is a relatively high ambient temperature (the region "A" of FIG. 4), it is possible to change the characteristic lines of the compressor so that the inclination of the characteristic lines may be changed from that of the lines in the region "B".

Figure 5:
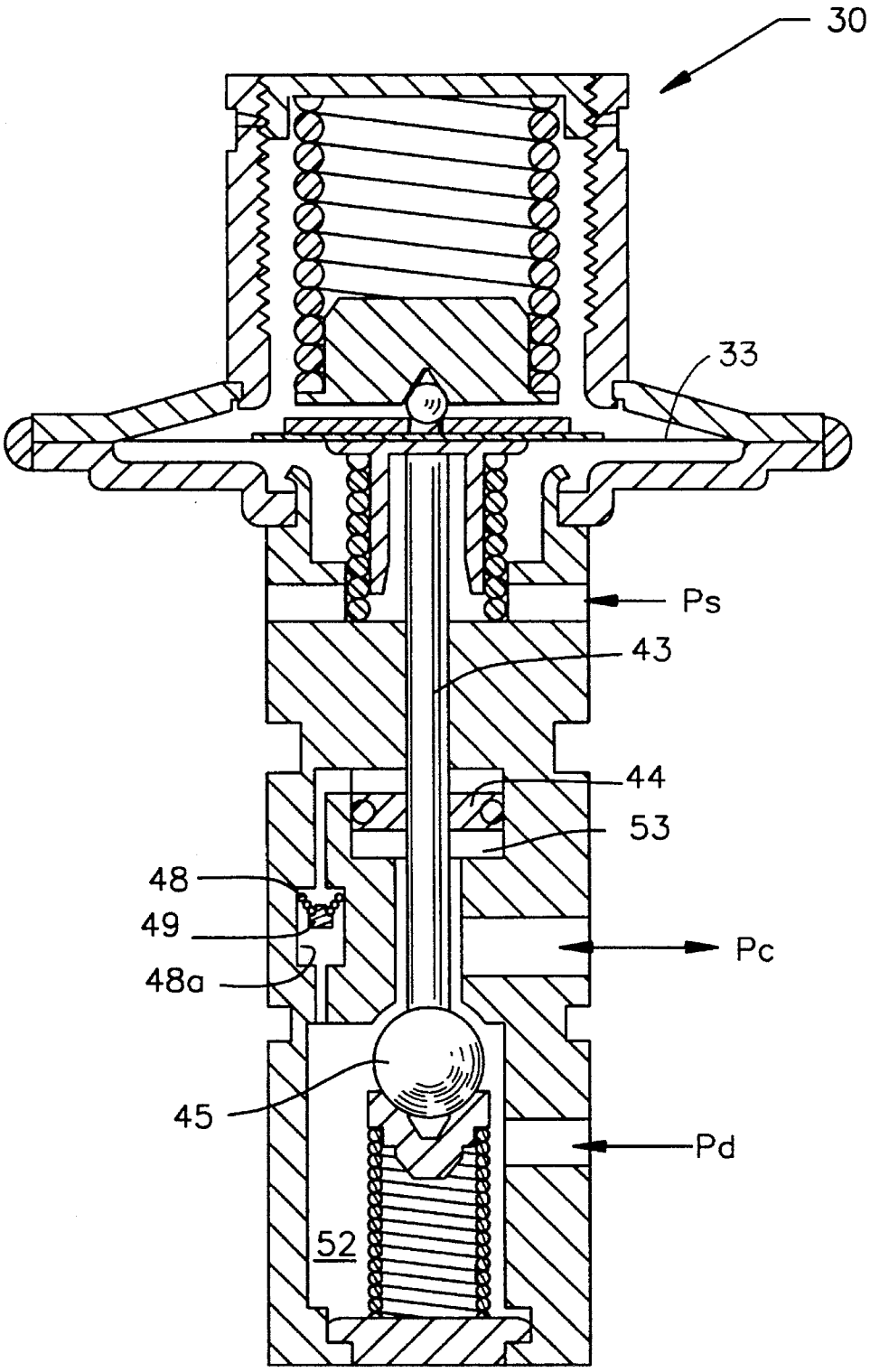
(PRIOR ART) FIG. 5

It will be understood from the foregoing description that the control valve 10 can exhibit the afore-mentioned advantageous operation without increasing the entire area of the diaphragm 13 thereof, or reducing the communication passageway 23. Thus, the size of the diaphragm 13 is not expanded in comparison with that of the control valve according to the prior art as shown in FIG. 5. Furthermore, a reduction in the amount of flow of the refrigerant gas does not occur.

In the control valve 10 of FIGS. 1 and 2, the compensating chamber 24, and the compensation-stopping chamber 25 may be axially arranged so as to be in axial registration with the discharge pressure chamber 23. Accordingly, the compensation-stopping chamber 23 may be arranged so as to be axially in series with the rod 16 connecting the diaphragm 13 and the spherical valve element 17. As a result, the internal construction of the control valve 10 can be simpler than that of the previously proposed control valve shown in FIG. 5.

The control valve 10 of the present invention permits the variable displacement refrigerant compressor to constantly exhibit a sufficient refrigerating performance irrespective of the ambient temperature. Therefore, when the compressor provided with the control valve 10 is mounted in any of the civic-use cars having means for switching from the use of the external air to the use of the internal air of the car and vice versa, it is possible to appropriately dehumidify the internal atmosphere of the car compartment even if the climate control is carried out by the climate control system using the internal air of the car during winter season, and accordingly, the window panes of the car are not frosted.

It should be understood that in the variable displacement wobble plate type refrigerant compressor provided with the control valve 10, the incorporation of the control valve 10 into the body of the compressor can be very simple. Further, the controlling performance of the control valve 10 can be sufficiently comparable with the previously proposed control valve shown in FIG. 5.

Since the internal structure of the control valve 10 according to the present invention can be simpler than that of the previously proposed control valve of FIG. 5, the manufacturing and assembling cost thereof can be low.

It should be understood that many variations and modifications of the control valve 10 will occur to persons skilled in the art without departing from the scope and spirit of the present invention as claimed in the accompanying claims.

For example, the diaphragm 13 of the pressure-sensing unit may be replaced with bellows for sensing a change in the suction chamber Ps.

Further, in the described embodiment, although the control valve 10 is used only for controlling the fluid communication between the crank chamber and the discharge chamber of the compressor, it may be possible to employ the control valve 10 for controlling the fluid communication between the crank chamber and both of the discharge and suction chambers as required.

Moreover, as one of the variations, the spherical valve 17 and the balancing rod 18 may be connected to one another by using magnetic force.

We claim:

1. A control valve for a variable displacement refrigerant compressor of a car-climate control system, which compressor has a suction chamber for refrigerant before compression, a discharge chamber for the refrigerant after compression, and a crank chamber for receiving therein a compression-drive mechanism, said control valve having a pressure-sensing means for providing movement of a control valve element in response to a change in suction pressure of the refrigerant gas, said control valve element controlling opening of a fluid communication passageway extending between at least said discharge chamber and said crank chamber to adjustably change a pressure level in said crank chamber to vary displacement of said compressor, wherein said control valve comprises: a compensation means for compensating for controlling operation of said control valve element when the pressure of discharged refrigerant gas is above a predetermined pressure level; and a compensation-stopping means for stopping the compensating operation of said compensating means when the pressure of the discharged refrigerant gas is reduced below the predetermined pressure level, wherein said valve means comprises: a discharge pressure change in direct communication with said discharge chamber of said compressor and in communication with a crank chamber of said compressor via an opening in a valve seat; and a control valve element arranged to be moved in a first axial direction toward a position where it is seated against said valve seat by said pressure-sensing means in relation to a rise in the suction pressure, wherein said compensating means comprises: a compensating chamber arranged at a position spaced from said discharge pressure chamber in a second axial direction opposite to the first axial direction, said compensating chamber in communication with said crank chamber of said compressor; and a balancing rod slidably arranged between said discharge pressure chamber and said compensating chamber, said balancing rod having a first end integral with said valve element of said valve means and a second free end in said compensating chamber; and, wherein said compensation-stopping means comprises: a compensation-stopping chamber arranged at a position further axially spaced from said discharge pressure chamber than said compensation chamber, in the direction opposite to that of the axial movement of said valve means toward said valve seat, said compensation-stopping chamber in communication with said discharge chamber of said compressor; and a high-pressure-compensating rod slidably arranged between said compensating chamber and said compensation-stopping chamber, said high-pressure-compensating rod arranged to be separated from or in contact with the said free end of said balancing rod of said compensation means, and being urged by a spring element in the second axial direction to separate from said free end of said balancing rod.

2. The control valve for a variable displacement refrigerant compressor of a car-climate control system according to claim 1, further comprising:

an axially extending valve-body member for integrally incorporating therein said pressure sensing means, said control valve element, said compensating means, and said compensation-stopping means, said pressure sensing means, said control valve element, said compensating means, and said compensation-stopping means being axially arranged in series in said valve body member.

3. The control valve for a variable displacement refrigerant compressor of a car-climate control system according to claim 2, wherein said valve body member has a flat open end tightly closed by a cap member to define, in said valve body member, a suction pressure chamber and an atmospheric pressure chamber isolated by a diaphragm of said pressure-sensing means, said valve body member having at a second end a port for introducing said discharge pressure from said discharge chamber of said compressor into said compensation-stopping chamber.

4. The control valve for a variable displacement refrigerant compressor of a car-climate control system according to claim 3, wherein said pressure-sensing means comprises:

said diaphragm member which moves in response to a change in said suction pressure prevailing in said suction pressure chamber with respect to said atmospheric pressure prevailing in said atmospheric pressure chamber; and a control valve element comprising a slidably fitted rod member having a first end connected to said diaphragm and a second end comprising a valve closing element, said rod member axially extending and defining an annular passageway therearound for providing a fluid communication between said discharge chamber and said crank chamber of said compressor.

5. The control valve for a variable displacement refrigerant compressor of a car-climate control system according to claim 4, wherein said valve closing element comprises a spherical valve element axially moved together with said rod member of said pressure-sensing means toward and away from said valve seat to thereby close and open the fluid communication between said discharge chamber and said crank chamber of said compressor.

6. The control valve for in a variable displacement refrigerant compressor of a car-climate control system according to claim 1, wherein said variable displacement refrigerant compressor comprises a variable displacement wobble plate type compressor provided with a cylinder block having a plurality of cylinder bores, a front housing connected to a front end of said cylinder block and defining said crank chamber therein, a rear housing connected to a rear end of said cylinder block and defining therein said suction chamber and said discharge chamber, said rear housing receiving said control valve therein.

* * * * *